US012680752B2

(12) United States Patent
Zhang et al.

(10) Patent No.: US 12,680,752 B2
(45) Date of Patent: Jul. 14, 2026

(54) REFRIGERATING APPLIANCE

(71) Applicant: BSH Hausgeräte GmbH, Munich (DE)

(72) Inventors: Yong Zhang, Nanjing (CN); Yongyan Shen, Chuzhou (CN); Wenqiao Wang, Nanjing (CN)

(73) Assignee: BSH Hausgeräte GmbH, Munich (DE)

( * ) Notice: Subject to any disclaimer, the term of this patent is extended or adjusted under 35 U.S.C. 154(b) by 163 days.

(21) Appl. No.: 18/597,241

(22) Filed: Mar. 6, 2024

(65) Prior Publication Data

US 2024/0302095 A1 Sep. 12, 2024

(30) Foreign Application Priority Data

Mar. 8, 2023 (CN) ..... 202320457938.0

(51) Int. Cl.
*F25D 23/06* (2006.01)

(52) U.S. Cl.
CPC ..... *F25D 23/066* (2013.01); *F25D 2201/10* (2013.01)

(58) Field of Classification Search
CPC .. F25D 23/066; F25D 2201/10; F25D 23/069; F25D 23/063
See application file for complete search history.

(56) References Cited

U.S. PATENT DOCUMENTS 4,044,449 A * 8/1977 Phan ..... F25D 23/063 264/46.7
5,875,599 A * 3/1999 McGrath ..... F25D 23/063 52/794.1
7,886,559 B2 * 2/2011 Hell ..... F25D 29/005 62/298
8,117,792 B2 * 2/2012 Kim ..... F25D 23/063 52/309.14
9,080,799 B2 * 7/2015 Hong ..... F25C 1/00
9,648,844 B2 * 5/2017 Jeong ..... A01J 25/12
9,816,747 B2 * 11/2017 An ..... F25D 23/066
(Continued)

FOREIGN PATENT DOCUMENTS

CN 106595172 A 4/2017
CN 103673453 B * 10/2018
(Continued)

*Primary Examiner* — Hanh V Tran
(74) *Attorney, Agent, or Firm* — Laurence A. Greenberg; Werner H. Stemer; Ralph E. Locher

(57) ABSTRACT

A refrigerating appliance includes a box body having a storage compartment and a thermal insulation compartment module, disposed in the storage compartment to define an accommodation compartment thermally insulated from the storage compartment. The thermal insulation compartment module includes a housing having first and second housing units. A first thermal insulation member is located in a first accommodating cavity of the first housing unit, and a second thermal insulation member is located in a second accommodating cavity of the second housing unit. One of the first and second housing units includes a first wall portion extending in a transverse direction of the storage compartment, the other one of the first and second housing units includes a second wall portion extending in a height direction of the storage compartment. Each of the first wall portion and the second wall portion defines a part of a boundary of the accommodation compartment.

15 Claims, 5 Drawing Sheets

(56) References Cited

U.S. PATENT DOCUMENTS

| | | | | |
|---|---|---|---|---|
| 10,746,454 | B2 * | 8/2020 | Hosamani | F25C 5/22 |
| 2009/0095006 | A1 * | 4/2009 | Smith | F25D 13/04 62/259.1 |
| 2017/0292773 | A1 * | 10/2017 | Yang | F25D 11/02 |
| 2018/0087826 | A1 * | 3/2018 | Hosamani | F25D 11/02 |
| 2019/0331395 | A1 * | 10/2019 | Choi | F25D 17/065 |
| 2020/0072525 | A1 * | 3/2020 | Makoto | F25D 23/003 |
| 2020/0166271 | A1 * | 5/2020 | Hosamani | F25D 11/02 |
| 2021/0116170 | A1 * | 4/2021 | Hosamani | F25D 23/069 |
| 2021/0318059 | A1 * | 10/2021 | Hosamani | F25D 23/028 |
| 2022/0065520 | A1 * | 3/2022 | Lazar | F25D 23/063 |
| 2022/0120431 | A1 * | 4/2022 | Ma | F25D 27/00 |
| 2022/0275993 | A1 * | 9/2022 | Yoon | F25D 17/065 |
| 2022/0341656 | A1 * | 10/2022 | Betz | F25D 23/063 |

FOREIGN PATENT DOCUMENTS

| | | | | | |
|---|---|---|---|---|---|
| CN | 112136013 | A | * | 12/2020 | F25D 23/12 |
| JP | 07269779 | A | * | 10/1995 | |
| JP | 2000314587 | A | * | 11/2000 | F25D 23/063 |
| KR | 20210080197 | A | * | 6/2021 | F25D 23/12 |
| KR | 102338214 | B1 | * | 12/2021 | F25D 13/00 |

* cited by examiner

REFRIGERATING APPLIANCE

CROSS-REFERENCE TO RELATED APPLICATION

This application claims the priority, under 35 U.S.C. § 119, of Chinese Patent Application CN 202320457938.0, filed Mar. 8, 2023; the prior application is herewith incorporated by reference in its entirety.

FIELD AND BACKGROUND OF THE INVENTION

This application relates to the field of refrigerating appliances.

At present, refrigerating appliances such as refrigerators are known and are used in everyday family life. To meet different requirements of consumers, a thermal insulation compartment module may be disposed in a refrigerating appliance, and the thermal insulation compartment module is disposed separately from a storage compartment. A thermal insulation wall usually needs to be disposed to avoid thermal exchange between the thermal insulation compartment module and the storage compartment, and a thermal insulation member is disposed in an accommodating cavity of the thermal insulation wall. In existing refrigerating appliances, a size and a shape of an accommodating cavity of a thermal insulation wall have a great impact on a size and a shape of a thermal insulation member, and at present the thermal insulation member may have nonuniform size or thickness distributions, leading to a reduced matching degree between the thermal insulation member and the accommodating cavity of the thermal insulation wall, which affects a thermal insulation effect.

SUMMARY OF THE INVENTION

To overcome at least one technical problem above, an objective of embodiments of this application is to provide an improved refrigerating appliance.

According to an embodiment of this application, a refrigerating appliance is provided, and includes: a box body, including a storage compartment; and a thermal insulation compartment module, disposed in the storage compartment to define an accommodation compartment thermally insulated from the storage compartment. The thermal insulation compartment module includes: a housing, having a first housing unit and a second housing unit. The first housing unit includes a first accommodating cavity and a first thermal insulation member located in the first accommodating cavity. The second housing unit includes a second accommodating cavity and a second thermal insulation member located in the second accommodating cavity. The first accommodating cavity is insulated from the second accommodating cavity and the first housing unit is connected to the second housing unit. One of the first housing unit and the second housing unit includes a first wall portion extending in a transverse direction of the storage compartment. The other one of the first housing unit and the second housing unit includes a second wall portion extending in a height direction of the storage compartment, and each of the first wall portion and the second wall portion defines a part of a boundary of the accommodation compartment.

Because accommodating cavities of a thermal insulation module are two independent cavity compartments, a shape and a structure are compact, so that a shape of the thermal insulation member is simplified, to help to improve matching between shapes and sizes of a thermal insulation member and an accommodating cavity, which is conducive to improving a thermal insulation effect.

According to an optional embodiment, the first housing unit, the second housing unit, and an inner wall of the storage compartment jointly define the accommodation compartment.

According to an optional embodiment, the first housing unit is connected to an adjacent inner wall of the storage compartment, and the second housing unit is connected to an adjacent inner wall of the storage compartment.

According to an optional embodiment, the first housing unit is connected to the second housing unit to form an L-shaped housing.

According to an optional embodiment, at least one of the first housing unit and the second housing unit extends in only one of the height direction and the transverse direction of the storage compartment.

According to an optional embodiment, one of the first housing unit and the second housing unit includes a main wall extending in one of the height direction and the transverse direction of the storage compartment and a boss that is bent from an end of the main wall to extend in the other one of the height direction and the transverse direction of the storage compartment, and the boss is connected to the other one of the first housing unit and the second housing unit.

According to an optional embodiment, the boss extends in the height direction of the storage compartment to make a connecting seam between the first housing unit and the second housing unit higher than a bottom wall of the accommodation compartment.

According to an optional embodiment, the first wall portion and the second wall portion have different thicknesses. According to an optional embodiment, the accommodation compartment has an opening that opens toward front of the storage compartment, the thermal insulation compartment module includes a support, and the support is respectively connected to the first housing unit and the second housing unit to jointly define the opening.

According to an optional embodiment, the support is approximately L-shaped.

According to an optional embodiment, one end of the support is connected to an end portion of the first housing unit away from a connection between the first housing unit and the second housing unit, and the other end of the support is connected to an end portion of the second housing unit away from the connection between the first housing unit and the second housing unit.

According to an optional embodiment, the first housing unit includes a first inner housing facing the accommodation compartment. The second housing unit includes a second inner housing facing the accommodation compartment, one end of the support is fastened to the first inner housing, and the other end of the support is fastened to the second inner housing.

According to an optional embodiment, opposite end surfaces at a connection between the first housing unit and the second housing unit form a labyrinth-shaped connection structure.

According to an optional embodiment, the labyrinth-shaped connection structure includes at least two stepped surfaces. According to an optional embodiment, a height difference between the stepped surfaces is not greater than 10 mm.

According to an optional embodiment, outer surfaces of the first housing unit and the second housing unit that are close to a position of a connection and face the storage compartment are located in a same plane.

According to an optional embodiment, inner surfaces of the first housing unit and the second housing unit that are close to a position of a connection and face the accommodation compartment are located in a same plane.

According to an optional embodiment, an outer surface of the first housing unit that faces the storage compartment has a first outer housing, an outer surface of the second housing unit that faces the storage compartment has a second outer housing, and the first outer housing and the second outer housing are coplanar.

According to an optional embodiment, the first housing unit has a first inner housing facing the accommodation compartment, the second housing unit has a second inner housing facing the accommodation compartment, and the first inner housing and the second inner housing are coplanar.

According to an optional embodiment, a first insert structure is provided at a connection between the first housing unit and the second housing unit to make one of the first housing unit and the second housing unit suitable for insertion with the other one of the first housing unit and the second housing unit in a first direction.

According to an optional embodiment, the appliance includes at least two groups of first insert structures, where the at least two groups of first insert structures are arranged at intervals in a second direction perpendicular to the first direction.

According to an optional embodiment, one of the at least two groups of first insert structures is arranged close to an inner surface of the housing, and the other one of the at least two groups of first insert structures is arranged close to an outer surface of the housing.

According to an optional embodiment, the first insert structure is located outside the first accommodating cavity and the second accommodating cavity.

According to an optional embodiment, the first insert structure includes a connection block disposed at one of connected opposite end surfaces of the first housing unit and the second housing unit and an insertion groove provided in the other one of the connected opposite end surfaces of the first housing unit and the second housing unit, and the connection block is inserted in the insertion groove in the first direction.

Other features which are considered as characteristic for the invention are set forth in the appended claims.

Although the invention is illustrated and described herein as embodied in a refrigerating appliance, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
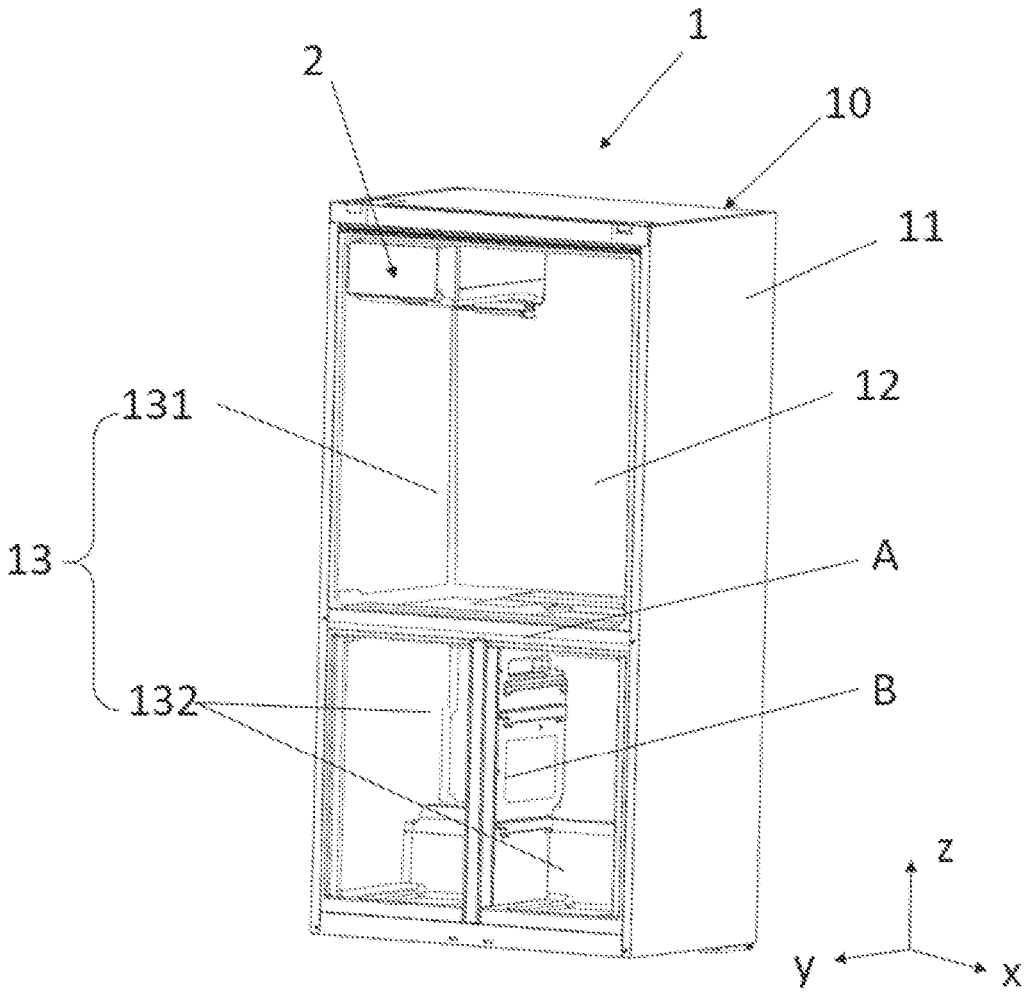
FIG. 1 is a diagrammatic, perspective view of a refrigerator according to an exemplary embodiment of the invention of the application.

The following is a summary list of reference numerals and the corresponding structure used in the above description of the invention:

REFERENCE NUMERALS

1—refrigerating appliance; 2—thermal insulation compartment module; 3—accommodation compartment; 7—support; 8—labyrinth-shaped connection structure; 10—box body; 11—shell; 12—inner wall; 13—storage compartment; 20—housing; 21—first housing unit; 22—second housing unit; 25—inner surface; 26—outer surface; 31—bottom wall; 33—opening; 41—first wall portion; 42—second wall portion; 51—main wall; 52—boss; 60—connecting seam; 73—second mounting hole; 75—first mounting hole; 100—seal member; 121—top wall; 122—rear wall; 123—side wall; 131—refrigerating compartment; 132—freezing compartment; 200—side plate; 201—third mounting hole; 211—first accommodating cavity; 212—first thermal insulation member; 213—first inner housing; 214—first outer housing; 221—second accommodating cavity; 222—second thermal insulation member; 223—second inner housing; 224—second outer housing; 226—open hole; 227—joint wall; stepped surface—81,82; 500—first insert structure; 501—connection block; 502—insertion groove; 1210—first joint hole; 1220—third joint hole; 1230—second joint hole; 2130—first buckle; 2140—first side wall; 2141—first opening; 2131—second buckle; 2142—bent wall; 2143—second opening; 2146—fourth opening; 2147—extending block; 2230—second side wall; 2231—third opening; 2232—third buckle; 2240—third side wall; 2246—fourth buckle; A—separating wall; B—separating wall; x—transverse direction; y—longitudinal direction; and z—height direction.

Hereinafter, this application is further described in conjunction with the accompanying drawings and specific implementations, and it is to be noted that new embodiments may be formed by any combination between the embodiments described below or between various technical features without causing any conflict.

In the description of this application, it should be understood that orientation or position relationships indicated by the terms such as "up", "down", "front", "rear", "height", "transverse", "horizontal", "inside", and "outside" are based on orientation or position relationships shown in the accompanying drawings, and are used only for ease and brevity of illustration and description, rather than indicating or implying that the mentioned apparatus or element needs to have a particular orientation or needs to be constructed and operated in a particular orientation. Therefore, such terms should not be construed as limiting of this application. In addition, the terms "first," "second," "third," "fourth," and the like are used to distinguish between similar elements, and these and other similar terms are not intended to limit the scope of this application.

According to embodiments of this application, for clear description, FIG. 1 shows an xyz coordinate system. A transverse direction x, a longitudinal direction y, and a height direction z that are perpendicular to each other two by two of a refrigerator in a conventional use state are schematically shown by arrows.

In an embodiment of this application, as shown in FIG. 1 to FIG. 8, a refrigerating appliance includes a box body 10, and the box body 10 has a shell 11 and an inner wall 12.

The inner wall 12 is disposed in the shell 11, and the inner wall 12 defines a plurality of storage compartments 13 that are open toward a front side. Each storage compartment 13 is separated by a separating wall A into a refrigerating compartment 131 and a freezing compartment 132. The refrigerating compartment 131 is located at an upper portion of the freezing compartment 132. The separating wall A and a separating wall B may be used for blocking thermal exchange between the refrigerating compartment 131 and the freezing compartment 132.

For the freezing compartment 132, the separating wall B divides the freezing compartment 132 into a left freezing compartment area and a right freezing compartment area.

Figure 2:
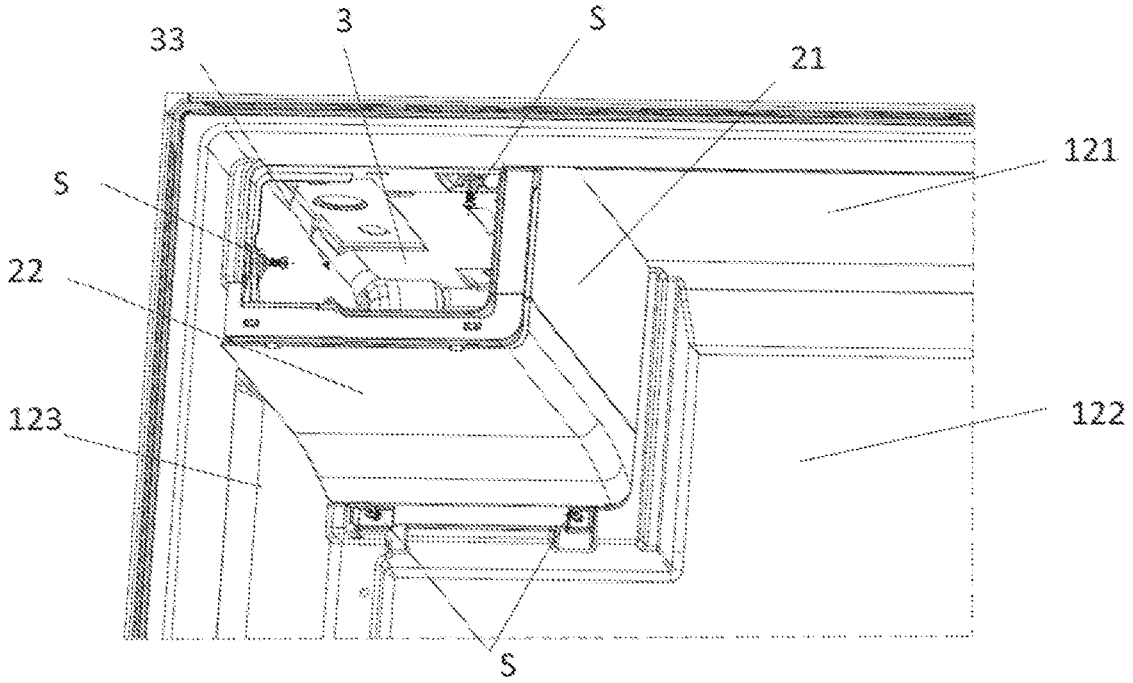
FIG. 2 is a perspective view of a thermal insulation compartment module of the refrigerator according to an exemplary embodiment of the invention.

According to an embodiment of this application, a thermal insulation compartment module 2 is disposed in a refrigerating appliance 1. As shown in FIG. 2, the thermal insulation compartment module 2 is disposed at an upper left corner of the refrigerating compartment 131.

The thermal insulation compartment module 2 has a housing 20. The housing 20 includes a first housing unit 21 and a second housing unit 22. The first housing unit 21 and the second housing unit 22 are adjacent and are connected together to form an "L" shape.

The first housing unit 21 extends in the height direction z of the refrigerating appliance to form a first wall portion 41. The first wall portion 41 includes a first inner housing 213 facing an accommodation compartment 3 and a first outer housing 214 facing the storage compartment 13.

The second housing unit 22 extends in the transverse direction x of the refrigerating appliance to form a second wall portion 42. The second wall portion 42 includes a second inner housing 223 facing the accommodation compartment 3 and a second outer housing 224 facing the storage compartment 13.

When the thermal insulation compartment module 2 is joined to the inner wall 12 of the refrigerating compartment, the first housing unit 21 is connected to a top wall 121 and a rear wall 122 of the inner wall 12; and the second housing unit 22 is connected to a side wall 123 and the rear wall 122 of the inner wall 12. In this way, the first housing unit 21, the second housing unit 22, and at least a part of the inner wall 12 jointly form the accommodation compartment 3.

Figure 7:
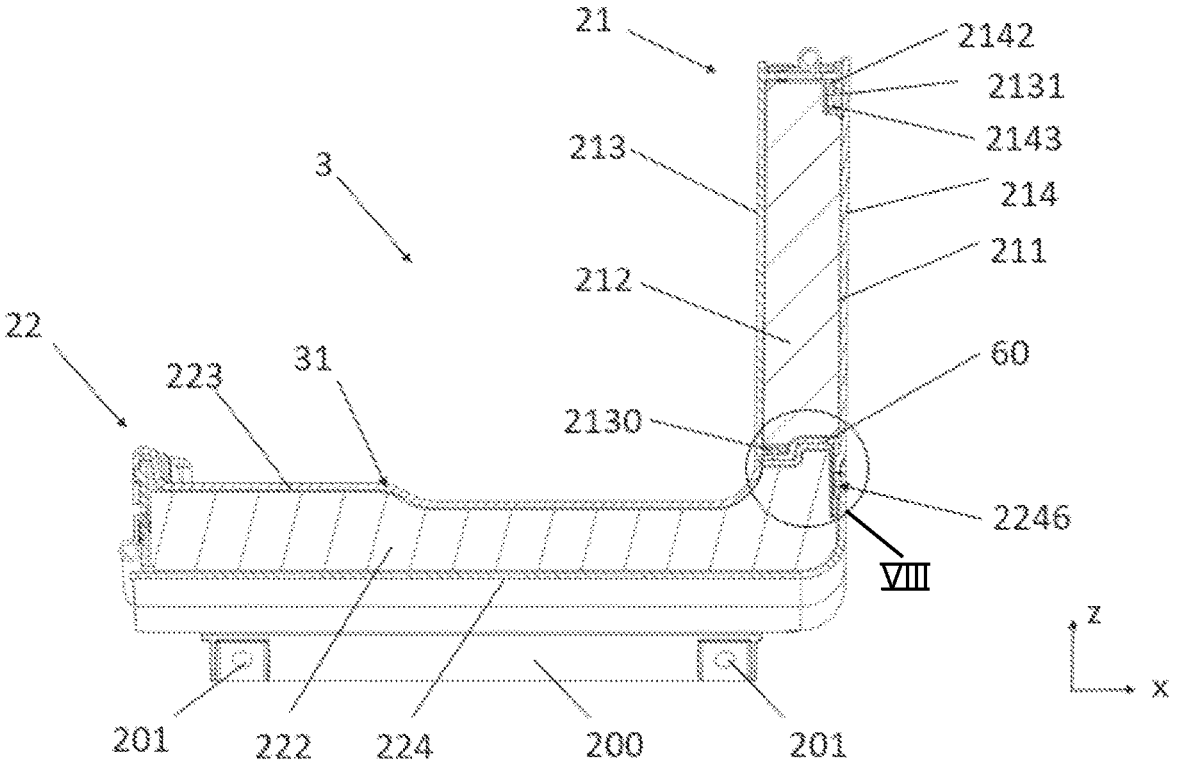
FIG. 7 is a cross-sectional view of the housing of the thermal insulation compartment module.
Figure 8:
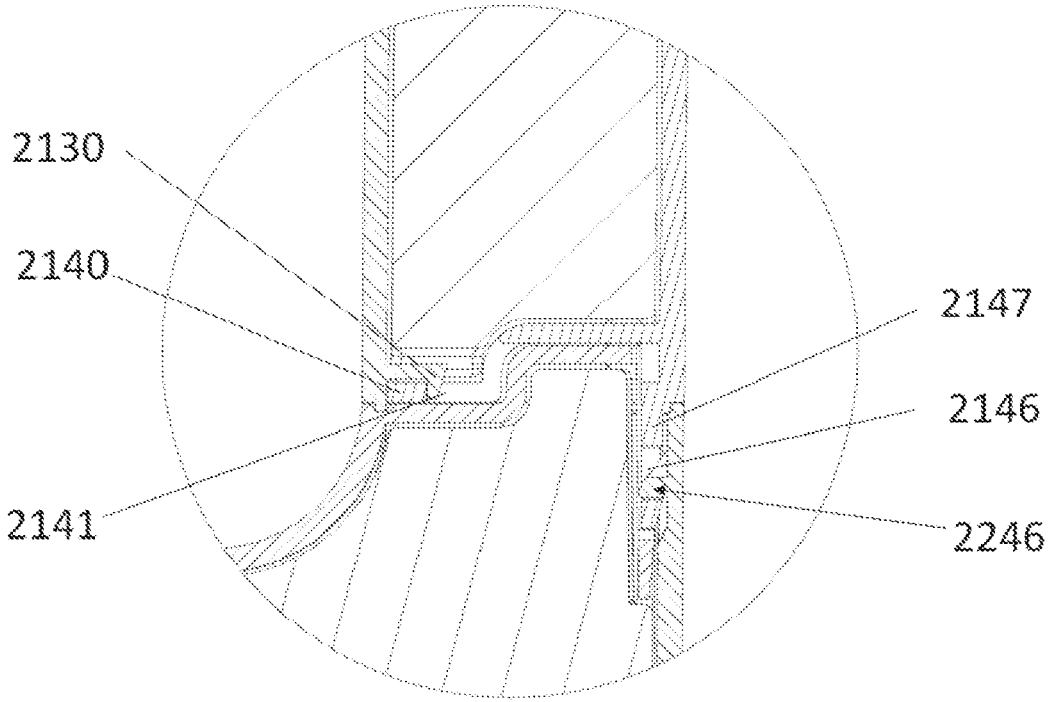
FIG. 8 is a partial sectional view of detail VIII shown in FIG. 7.
Figure 9:
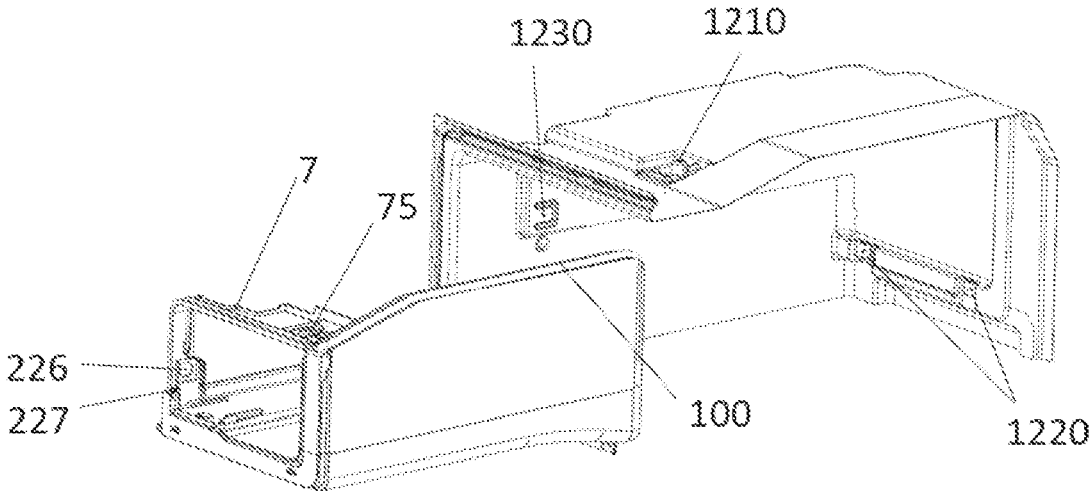
FIG. 9 is an exploded, perspective view of the thermal insulation compartment module of the refrigerator according to an exemplary embodiment of the invention.

As shown in FIG. 7 and FIG. 8, at a lower portion of the first inner housing 213, a first buckle 2130 is disposed in the transverse direction x. At a lower portion of the first outer housing 214, a first side wall 2140 extends in the transverse direction x, and a first opening 2141 is provided in the first side wall 2140. The first buckle 2130 and the first opening 2141 are clamped together.

A second buckle 2131 extends downward from an upper portion of the first inner housing 213. A bent wall 2142 extends upward on a side of the first outer housing 214 facing a first accommodating cavity 211 in the height direction z, and a second opening 2143 is provided in the bent wall 2142. The second buckle 2131 and the second opening 2143 are clamped together.

The first inner housing 213 and the first outer housing 214 are fastened together by the foregoing two buckle connection structures, and are separated by an interval to define the first accommodating cavity 211. A first thermal insulation member 212 is arranged in the first accommodating cavity 211.

Figure 4:
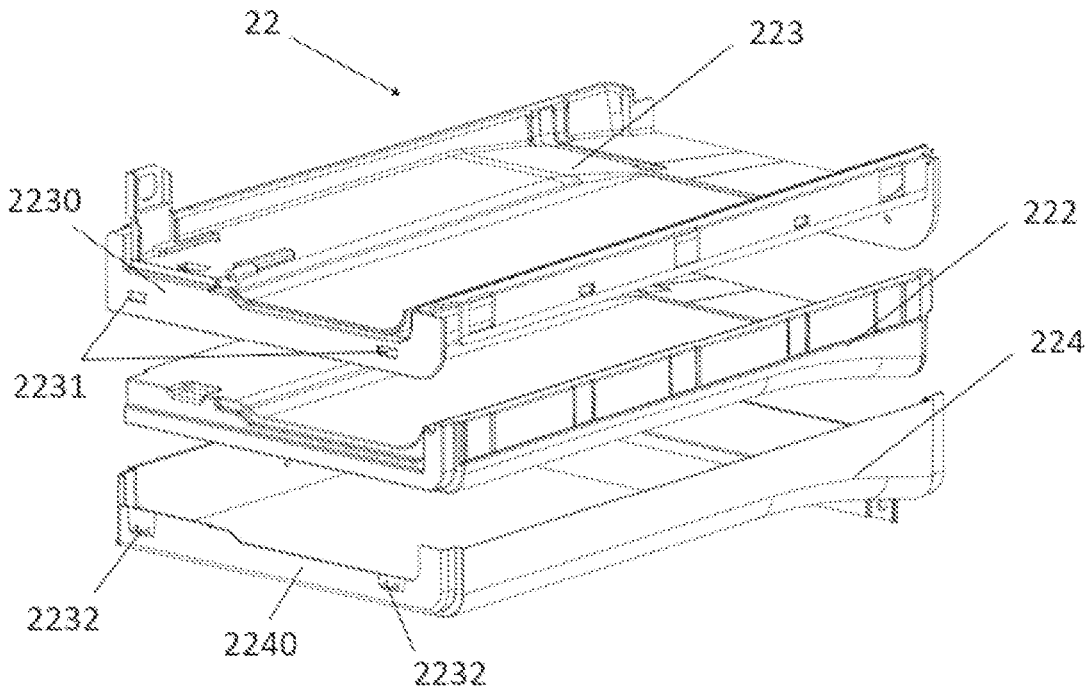
FIG. 4 is an exploded, perspective view of a second housing unit of a thermal insulation compartment module.

As shown in FIG. 4, the second inner housing 223 includes a second side wall 2230 extending downward in the height direction z, and a plurality of third openings 2231 are provided in the second side wall 2230. The second outer housing 224 includes a third side wall 2240 facing upward in the height direction z. A plurality of third buckles 2232 connected to the third openings 2231 are disposed on the third side wall 2240. The third openings and the third buckles are clamped together, to enable the second inner housing 223 and the second outer housing 224 to be fastened together.

The second inner housing 223 and the second outer housing 224 are separated by an interval to define a second accommodating cavity 221.

A second thermal insulation member 222 is arranged in the second accommodating cavity 221.

Because accommodating cavities of a thermal insulation module are two independent cavity compartments, a shape and a structure are compact, so that a shape of the thermal insulation member is simplified, to help to improve matching between shapes and sizes of a thermal insulation member and an accommodating cavity, which is conducive to improving a thermal insulation effect.

Figure 5:
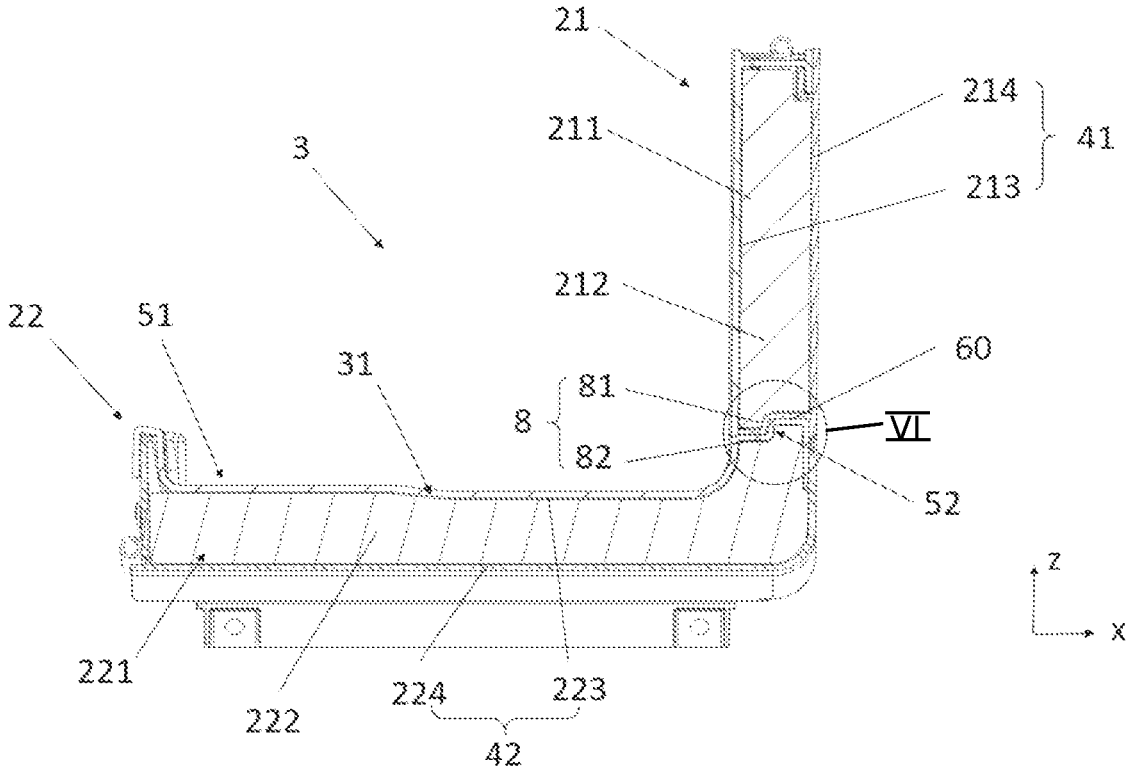
FIG. 5 is a cross-sectional view of a housing of the thermal insulation compartment module.
Figure 6:
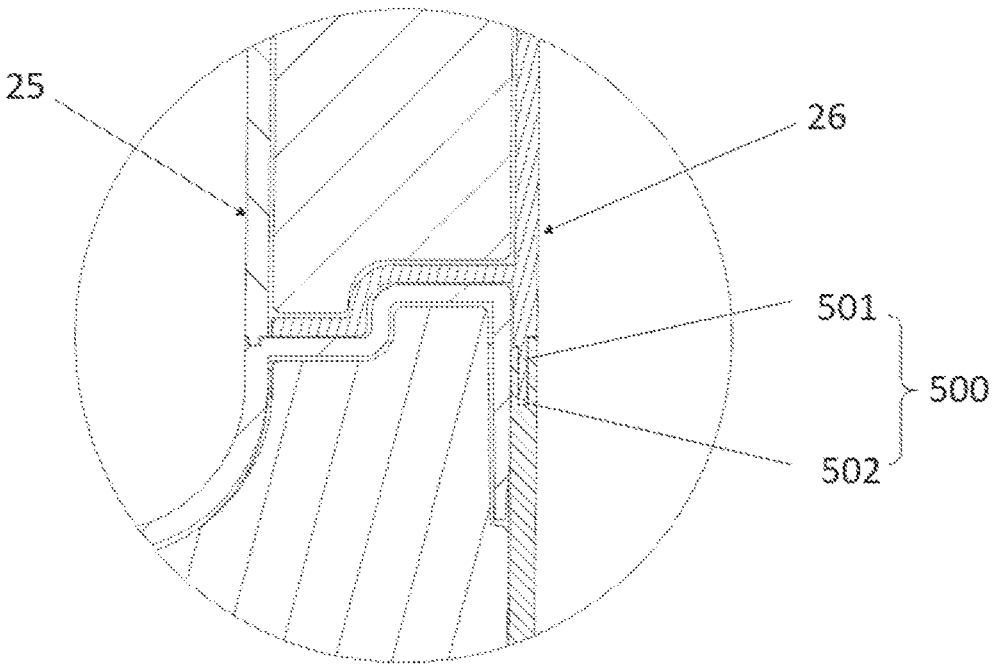
FIG. 6 is a partial sectional view of detail VI shown in FIG. 5.

As shown in FIG. 5, the second housing unit 22 includes a main wall 51 extending in the transverse direction x of the storage compartment 13. The second housing unit 22 further includes a boss 52 bent from the main wall 51 toward the top wall 121 of the storage compartment 13.

The boss 52 is connected to a lower end portion of the first housing unit 21, and a connecting seam 60 is formed on a connection end surface between the two. A position of the connecting seam 60 is higher than a bottom wall 31 of the accommodation compartment 3, that is, higher than the second inner housing 223 of the second housing unit 22.

The first wall portion 41 of the first housing unit 21 and the second wall portion 42 of the second housing unit 22 have different thicknesses. In an embodiment of this application, the thickness of the second wall portion 42 is smaller than the thickness of the first wall portion 41. In this case, different wall thicknesses may be selected according to different performance requirements, to ensure a good thermal insulation effect.

The connection end surface of the first housing unit 21 is a first stepped surface 81, and correspondingly a connection end surface of the second housing unit 22 is a second stepped surface 82. The two stepped surfaces 81, 82 are cooperatively connected to form a labyrinth-shaped connection structure 8, to increase the complexity of an air flow path, so that thermal exchange between the accommodation compartment and the storage compartment can be reduced.

According to an embodiment of this application, a height difference between the two stepped surfaces is not greater than 10 mm, preferably, 4 mm to 8 mm.

To improve the overall beauty of the housing 20 of the thermal insulation compartment module 2, the first outer housing 214 of the first housing unit 21 facing the storage compartment 13 and the second outer housing 224 of the second housing unit 22 facing the storage compartment 13 are located in a same plane in the height direction. The first inner housing 213 of the first housing unit 21 facing the accommodation compartment 3 and the second inner housing 223 of the second housing unit 22 facing the accommodation compartment 3 are located in a same plane in the height direction.

To make the first housing unit 21 and the second housing unit 22 coplanar at a connection for the beauty effect, at connected opposite end surfaces of the first housing unit 21 and the second housing unit 22, the first outer housing 214 and the first inner housing 213 form a connection block 501 extending in a first direction, that is, the height direction z of the storage compartment, and an insertion groove 502 is correspondingly formed in the second outer housing 224 and the second inner housing 223. The connection block 501 is inserted in the insertion groove 502 in the first direction, to form an insert structure 500.

A plurality of groups of insert structures 500 are formed at the connection between the first housing unit 21 and the second housing unit 22.

The insert structure 500 is located outside the first accommodating cavity 211 and the second accommodating cavity 221.

The plurality of groups of insert structures 500 are arranged at intervals in a second direction, that is, the longitudinal direction y of the box body, to limit the first housing unit 21 and the second housing unit 22, which helps to implement that the first housing unit 21 and the second housing unit 22 are coplanar at the connection.

Figure 3:
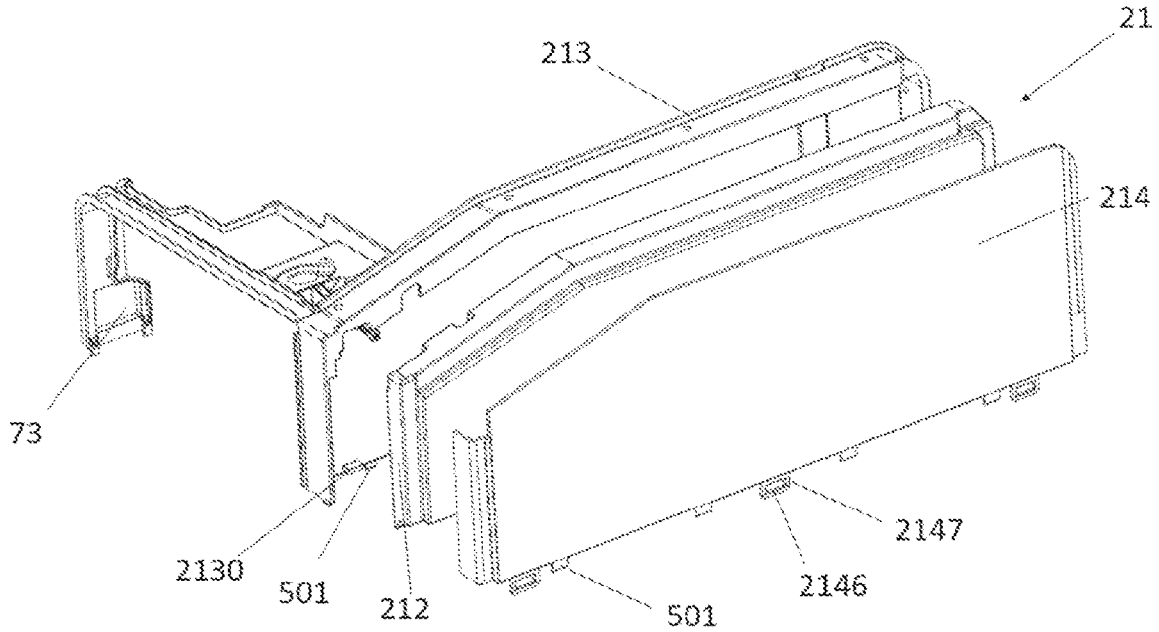
FIG. 3 is an exploded, perspective view of a first housing unit of the thermal insulation compartment module.

As shown in FIG. 3, FIG. 7, and FIG. 8, at the connected opposite end surface of the first housing unit 21, an extending block 2147 protrudes from the first outer housing 214 in the height direction z. The extending block 2147 has a fourth opening 2146. A fourth buckle 2246 is disposed on the second outer housing 224 of the second housing unit 22. The fourth buckle 2246 is clamped with the fourth opening 2146 of the extending block 2147, to fasten the first housing unit 21 and the second housing unit 22.

A support 7 is disposed in a direction of the accommodation compartment 3 toward an opening 33 in the storage compartment 13. The support 7 is approximately L-shaped. One end of the support 7 is connected to an end portion of the first housing unit 21 away from the connection between the first housing unit 21 and the second housing unit 22, that is, a position of the first housing unit 21 close to the top wall 121 of the storage compartment 13. The other end of the support 7 is connected to an end portion of the second housing unit 22 away from the connection between the first housing unit 21 and the second housing unit 22, that is, a position of the second housing unit close to the side wall 123 of the storage compartment 13.

A first mounting hole 75 is provided at a position of the support 7 close to the first housing unit 21, and a fastening member S can pass through the first mounting hole 75 in the support 7 to be fastened to a first joint hole 1210 in the top wall 121 of the storage compartment 13.

A joint wall 227 is disposed on the second inner housing of the second housing unit 22, and the joint wall 227 extends in the height direction z of the storage compartment. An open hole 226 is provided in the joint wall 227.

A second mounting hole 73 in the support 7 and the open hole 226 in the joint wall 227 are fastened to a second joint hole 1230 in the inner wall 12 by the fastening member S.

An end portion of the second outer housing 224 of the second housing unit 22 away from the opening in the storage compartment 13 is bent downward to form a side plate 200. One or more third mounting holes 201 are provided in the side plate 200. The fastening member S passes through the third mounting holes 201 in the second housing unit 22 to be fastened to a third joint hole 1220 in the inner wall 12.

In this case, the support 7, the housing 20, and the inner wall 12 of the storage compartment 13 may be fixedly connected together, to form the accommodation compartment 3 of the thermal insulation compartment module 2.

According to an embodiment of this application, as shown in FIG. 8, the thermal insulation compartment module 2 is located at an upper left corner of the storage compartment 13, and a seal member 100 is disposed between the housing 20 of the thermal insulation compartment module 2 and the inner wall 12 of the storage compartment 13. The seal member 100 may be made of a material such as sponge, rubber or silicone, to achieve good sealing between the accommodation compartment 3 and the storage compartment 13, thereby enhancing a thermal insulation effect.

Although specific implementations have been described above, these implementations are not intended to limit the scope of this application, even if only one implementation is described with respect to specific features. The feature example provided in this application is intended to be illustrative rather than limiting, unless otherwise stated. During specific embodiment, a plurality of features may be combined with each other according to actual requirements and where technically feasible. In particular, features in different embodiments may also be combined with each other. Various substitutions, changes, and modifications may also be conceived without departing from the spirit and scope of this application.

The invention claimed is:

1. A refrigerating appliance, comprising:

a box body having a storage compartment; and a thermal insulation compartment module disposed in said storage compartment and defining an accommodation compartment thermally insulated from said storage compartment, wherein said thermal insulation compartment module includes:

a housing having a first housing unit and a second housing unit, said first housing unit having a first accommodating cavity formed therein and a first thermal insulation member disposed in said first accommodating cavity, said second housing unit having a second accommodating cavity formed therein and a second thermal insulation member disposed in said second accommodating cavity, said first accommodating cavity is insulated from said second accommodating cavity;

said first housing unit connected to said second housing unit, one of said first housing unit and said second housing unit containing a first wall portion extending in a transverse direction of said storage compartment, another one of said first housing unit and said second housing unit containing a second wall portion extending in a height direction of said storage compartment, and each of said first wall portion and said second wall portion defining a part of a boundary of said accommodation compartment; and one of said first wall portion and said second wall portion containing a main wall extending in one of the height direction or the transverse direction of said storage compartment and a boss that is bent from an end of said main wall to extend in an other one of the height direction or the transverse direction of said storage compartment, and said boss is connected to an other one of said first housing unit and said second housing unit, wherein at least one of said first housing unit and said second housing unit extends in only one of the height direction and the transverse direction of said storage compartment.

2. The refrigerating appliance according to claim 1, wherein:

said first housing unit, said second housing unit, and an inner wall of said storage compartment jointly define said accommodation compartment; and/or said first housing unit is connected to an adjacent inner wall of said storage compartment, and said second housing unit is connected to said adjacent inner wall of said storage compartment; and/or said first housing unit is connected to said second housing unit to form an L-shaped housing.

3. The refrigerating appliance according to claim 1, wherein said boss extends in the height direction of said storage compartment to make a connecting seam between said first housing unit and said second housing unit higher than a bottom wall of said accommodation compartment.

4. The refrigerating appliance according to claim 1, wherein said first wall portion and said second wall portion have different thicknesses.

5. The refrigerating appliance according to claim 1, wherein:

said accommodation compartment has an opening formed therein that opens toward a front of said storage compartment; and said thermal insulation compartment module contains a support, and said support is respectively connected to said first housing unit and said second housing unit to jointly define said opening.

6. The refrigerating appliance according to claim 5, wherein:

said support is substantially L-shaped; and/or a first end of said support is connected to an end portion of said first housing unit away from a connection between said first housing unit and said second housing unit, and a second end of said support is connected to an end portion of said second housing unit away from said connection between said first housing unit and said second housing unit; and/or said first housing unit contains a first inner housing facing said accommodation compartment, said second housing unit contains a second inner housing facing said accommodation compartment, a first end of said support is fastened to said first inner housing, and a second end of said support is fastened to said second inner housing.

7. The refrigerating appliance according to claim 1, wherein opposite end surfaces at a connection between said first housing unit and said second housing unit form a labyrinth-shaped connection structure.

8. The refrigerating appliance according to claim 7, wherein said labyrinth-shaped connection structure contains at least two stepped surfaces.

9. The refrigerating appliance according to claim 8, wherein a height difference between said at least two stepped surfaces is not greater than 10 mm.

10. The refrigerating appliance according to claim 1, wherein:

outer surfaces of said first housing unit and of said second housing unit that are close to a position of a connection and face said storage compartment are disposed in a same plane; and/or inner surfaces of said first housing unit and of said second housing unit that are close to the position of the connection and face said accommodation compartment are disposed in a same plane; and/or an outer surface of said first housing unit that faces said storage compartment defines a first outer housing, an outer surface of said second housing unit that faces said storage compartment defines a second outer housing, and said first outer housing and said second outer housing are coplanar; and/or said first housing unit has a first inner housing facing said accommodation compartment, said second housing unit has a second inner housing facing said accommodation compartment, and said first inner housing and said second inner housing are coplanar.

11. The refrigerating appliance according to claim 1, further comprising a first insert structure disposed at a connection between said first housing unit and said second housing unit to make one of said first housing unit and said second housing unit suitable for insertion with an other one of said first housing unit and said second housing unit in a first direction.

12. The refrigerating appliance according to claim 11, wherein said first insert structure is one of at least two groups of first insert structures, wherein:

said at least two groups of said first insert structures are disposed at intervals in a second direction perpendicular to the first direction; and/or one of said at least two groups of said first insert structures is disposed close to an inner surface of said housing, and an other one of said at least two groups of said first insert structures is disposed close to an outer surface of said housing; and/or said first insert structures are disposed outside said first accommodating cavity and said second accommodating cavity.

13. The refrigerating appliance according to claim 11, wherein:

said first insert structure includes a connection block disposed at one of connected opposite end surfaces of said first housing unit and said second housing unit; and an other one of said connected opposite end surfaces of said first housing unit and said second housing unit has an insertion groove formed therein, and said connection block is inserted in said insertion groove in the first direction.

14. The refrigerating appliance according to claim 1, wherein said first housing unit, said second housing unit, and an inner wall of said storage compartment jointly define said accommodation compartment.

15. The refrigerating appliance according to claim 1, wherein said boss does not extend across a full width of said end of said main wall.

* * * * *